US008438022B2

(12) United States Patent
Fallat et al.

(10) Patent No.: US 8,438,022 B2
(45) **Date of Patent: *May 7, 2013**

(54) SYSTEM THAT DETECTS AND IDENTIFIES PERIODIC INTERFERENCE

(75) Inventors: Mark Fallat, Vancouver (CA); Derek Sahota, Hamilton (CA)

(73) Assignee: QNX Software Systems Limited, Kanata, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/444,182

(22) Filed: Apr. 11, 2012

(65) Prior Publication Data

US 2012/0197639 A1 Aug. 2, 2012

Related U.S. Application Data

(63) Continuation of application No. 12/070,798, filed on Feb. 21, 2008, now Pat. No. 8,180,634.

(51) Int. Cl.
*G10L 21/02* (2006.01)

(52) U.S. Cl.
USPC ..... 704/233; 704/226; 704/228; 381/94.1; 381/94.3

(58) Field of Classification Search ..... 704/233, 704/226, 228; 381/94.1, 94.3
See application file for complete search history.

(56) References Cited

U.S. PATENT DOCUMENTS

| | | | | |
|---|---|---|---|---|
| 5,963,901 | A | 10/1999 | Vähätalo et al. | 704/233 |
| 6,035,048 | A * | 3/2000 | Diethorn | 381/94.3 |
| 6,233,551 | B1 * | 5/2001 | Cho et al. | 704/208 |
| 8,073,689 | B2 | 12/2011 | Hetherington et al. | 704/233 |
| 2003/0198304 | A1 | 10/2003 | Sugar et al. | 375/340 |
| 2004/0167776 | A1 * | 8/2004 | Go et al. | 704/208 |
| 2006/0116873 | A1 * | 6/2006 | Hetherington et al. | 704/226 |
| 2008/0292033 | A1 * | 11/2008 | Belogolovy et al. | 375/346 |

* cited by examiner

*Primary Examiner* — Vincent P Harper
(74) *Attorney, Agent, or Firm* — Brinks, Hofer, Gilson & Lione

(57) ABSTRACT

A system improves speech detection or processing by identifying registration signals. The system encodes a limited frequency band by varying the amplitude of a pulse width modulated signal between predefined values. The signal is separated into frequency bins that identify amplitude and phase. The registration signal is measured by comparing a difference in average acoustic power in a plurality of adjacent bins over time.

20 Claims, 10 Drawing Sheets

SYSTEM THAT DETECTS AND IDENTIFIES PERIODIC INTERFERENCE

PRIORITY CLAIM

This application is a continuation of U.S. application Ser. No. 12/070,798 "System that Detects and Identifies Periodic Interference," filed on Feb. 21, 2008, which is incorporated herein by reference.

BACKGROUND OF THE INVENTION

1. Technical Field

This disclosure relates to a speech processes, and more particularly to a process that identifies interference that may occur during a registration process.

2. Related Art

Speech processing is susceptible to environmental noise and electromagnetic interference. Some interference may combine with other noise to reduce speech intelligibility and quality.

Some systems attempt to suppress this noise by reducing wireless phone transmission power. Other systems attempt to suppress this noise by changing transmission protocols. Other systems use shielding to insulate handsets and vehicle based systems. Each of these systems may require additional hardware that may be expensive and difficult to implement. There is a need for a system that identifies interference, has minimal latency, and may be implemented through hardware and/or software.

SUMMARY

A system improves speech detection by identifying harmonic signals. The system encodes a limited frequency band by varying the amplitude of a pulse between predefined values. The signal is separated into frequency bins that identify amplitude and phase. The harmonic signal is measured by comparing a difference in average acoustic power in a plurality of bins over time. The harmonic signal may be identified without analyzing pitch.

Other systems, methods, features, and advantages will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Some speech processors operate when voice is present. In these systems certain aspects of the process change when voice is processed. In practice, such systems are efficient and effective when only voice is detected. When noise or other interference is mistaken for voice, the noise may be amplified or may corrupt the data that is interpreted and executed by the speech processor. Interference may occur when a device sends out a time varying registration signal. Such a signal may be used in a Global System for Mobile Communication (GSM), Time Division Multiple Access (TDMA), and/or Code Division Multiple Access registration process, for example. These systems may transmit strong electromagnetic pulses that may be mistakenly processed as speech.

In some registration processes, such as a GSM registration process, a device may generate an electromagnetic pulse having a strong harmonic structure. The fundamental frequency and multiples thereof may lie within the aural band. When this occurs, a speech processor or voice detection process may process the registration signal as speech. In systems that have low processing power (e.g., in a vehicle, car, or in a hand-held system) or are not pitched based, false triggers may substantially reduce the efficiency, reliability, or accuracy of the speech processor or voice detection process.

Figure 1:
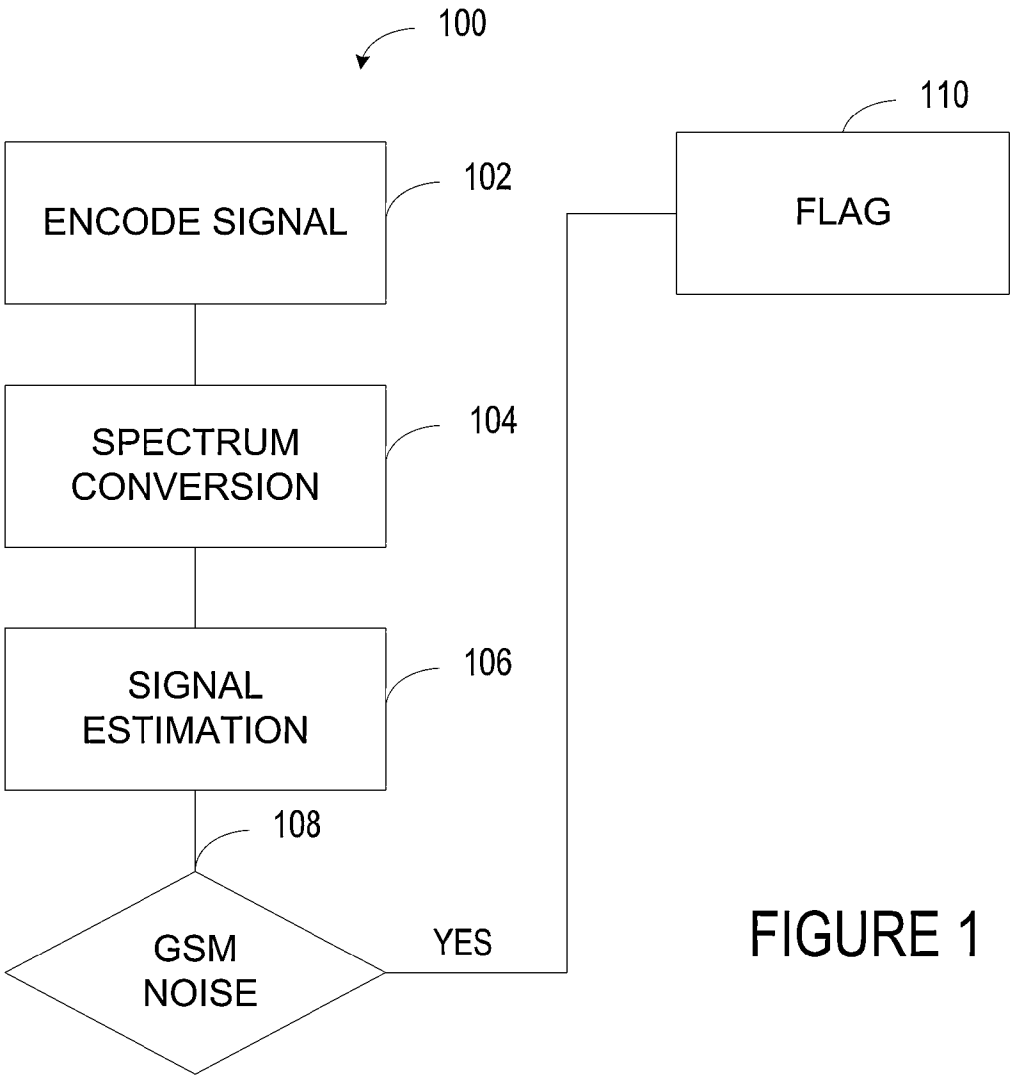
FIG. 1 is a detection process that identifies interference.

FIG. 1 is a flow diagram of a process that identifies a repetitive interference that may be mistaken for voice. At 102 a received or detected signal is digitized at a predetermined frequency. To assure a good quality input, the signal may be encoded into a signal by varying the amplitude of multiple pulses limited to predefined values. At 104 a complex spectrum for the windowed signal may be obtained through a Fast Fourier Transform (an FFT) that separates the digitized signals into frequency bins, with each bin identifying an amplitude and a phase across a small frequency range.

At 106, a potential periodic interference or noise is measured or estimated. The noise measurement or estimate may be an average of the acoustic power in each or a number of frequency bins. The process may make a comparison between multiple sets of adjacent frequency bins (e.g., the sets may or may not adjoin) to derive a measurement or estimate over time. In some processes, a time-smoothed or running average may be computed to smooth out the measurement or estimate of the frequency bins before a comparison occurs.

At 108, periodic noise may be identified when the difference between the frequency bins exceeds a programmed (or predetermined) threshold. To assure accurate detection, some processes may require a predetermined number of comparisons to exceed the programmed threshold (or predetermined threshold) before identifying a periodic noise. The threshold may be empirically determined, and in some processes (and systems later described), may be programmed or modified by a user through a user interface. In some processes and systems, a user may increase or decrease the number of buffers or bins that are monitored, averaged, and/or compared. At 110, the analysis may discriminate or mark portions of the input as noise by setting a flag, marker, or transmitting a signal that identifies a status. Since periodic noise may comprise multiple harmonics, it may be identified by processing a portion of the spectrum but marking it across its duration or across its aural band. For example, the process may identify the fundamental frequency and harmonics (an integer multiple of the fundamental frequency) in a GSM registration process by analyzing a low frequency range. In one application, GSM buzz was identified and marked beyond 1500 Hz (for the duration of the signal in the aural band) by processing a frequency range lower than about 1500 Hz.

To overcome the effects of the interference, an ancillary process or device in communication with the process 100 or system may monitor the flag, marker, or transmitted signal. When received, the ancillary process or device may not trigger or process the input signal as speech. Other methods or devices may process the input with knowledge that a portion may be corrupted. These processes interpret or process the flag, marker, and/or signal.

Figure 2:
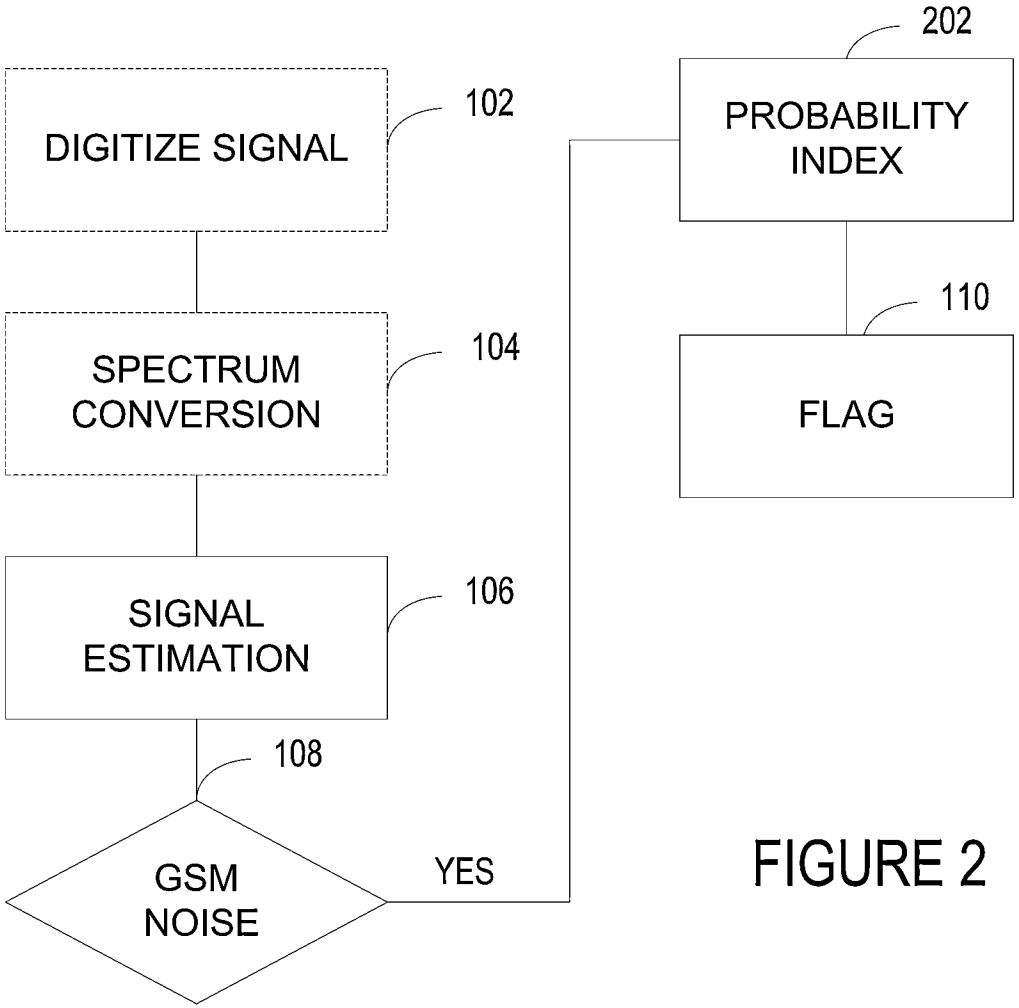
FIG. 2 is a second detection process that identifies interference.

FIG. 2 is an alternative detection process that identifies periodic interference or noise. The process of converting portions of the continuously varying input signal to the digital and frequency domains, respectively, at 102 and 104 may be optional (shown by dashed lines). In the time domain, the block-like structure of the periodic noise or interference may be characterized by its transient-like rise. Its amplitude decays across a substantially constant width at a moderate slope (e.g., the pulse width may correspond to the clock frequency of the registration device) before falling quickly below a noise floor at nearly an infinite slope. The signal may be measured or estimated at 106. When processed in the frequency domain, the measurement may occur across multiple frequency bins that may be smoothed or averaged.

To detect the periodic noise or interference, the measured or estimated difference between adjacent frequency bins may be compared to a pre-programmed or predetermined (e.g., user adjustable) threshold at 108. One or multiple sets of bins may be compared (e.g., a threshold test) to identify when the threshold is exceeded and when it is not. The comparison at 108 may generate a marker, flag, or signal indicating the status of the noise condition at 110. Depending on its use, the marker or flag may comprise a code stored in a local or remote memory, it may be embedded in data (including the input or processed signal), or may comprise one or more bits set internally by hardware or software to indicate the occurrence of a periodic noise event. The flag, marker, or signal may indicate when the noise occurs, and in some processes, may indicate its duration (e.g., in a GSM application it may indicate the pulse width of the registration signal). In other processes, the duration of the noise may determine how long a flag is set or a how long a status signal is transmitted. The likelihood of the detection or a probability index may also be generated at 202 before the marker, flag, or signal is generated at 110. The probability index may be a ratio of the number of actual occurrences of a periodic noise event to the number of possible occurrences, and in some processes, may determine when the marker, flag, or signal is generated. In alternative processes the probability index may comprise the output of the signal estimation 106. In some processes it may be converted to the time domain.

Figure 3:
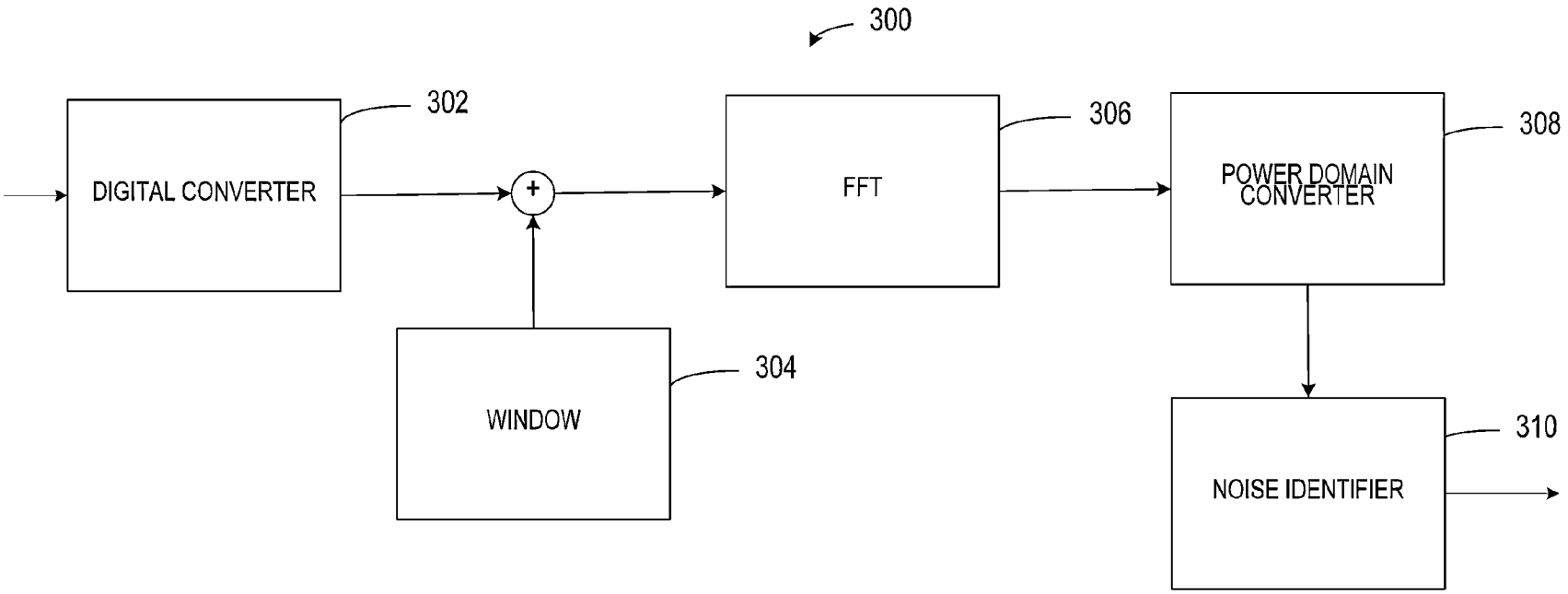
FIG. 3 is a detector that identifies noise or other interference.

FIG. 3 is a block diagram of a detector that identifies noise and interference having harmonic structure. The periodic noise may occur naturally or may be artificially generated (e.g., a registration process of a telephone). The periodic noise detector may detect a repetitive signal from the remaining signal in a real or in a delayed time no matter how complex or loud the signal may be. When detected, the system may set a flag, mark, or transmit a status signal.

In FIG. 3, the digital converter may receive an unvoiced, fully voiced, or mixed voice input signal. A received or detected signal may be digitized at a predetermined frequency. To assure a good quality, the input signal may be converted to a Pulse-Code-Modulated (PCM) signal. A smooth window 304 may be applied to a block of data to obtain the windowed signal. The complex spectrum of the windowed signal may be obtained by a Fast Fourier Transform (FFT) device 306 that separates the digitized signals into frequency bins, with each bin identifying an amplitude and phase across a small frequency range. Each frequency bin may be converted into the power-spectral domain 308 to develop a signal estimate. A time-smoothed or weighted average may be used to estimate the amplitude of the signal for each frequency bin and/or a number of frequency bins.

To detect periodic noise in an aural band, selected portions of the spectrum or differences may be compared to a programmable or a pre-programmed threshold (or thresholds) by a comparator resident or linked to the noise identifier 310. To select signals transmitted during a registration process, for example, differences in a selected portion of the low frequency spectrum are compared to the programmable or pre-programmed threshold(s) by the noise identifier 310. When a difference or covariance in amplitude of one or more sets of bins (depending on the application) exceed the threshold(s), a marker, or flag may be set or the status signal may be transmitted. The marker, flag, or signal may be stored in a local or remote memory, it may be embedded and/or encoded in data (including the input of the detector 300 or the processed signal), or may comprise one or more bits set internally by hardware or software to indicate the occurrence of a periodic noise event. The flag, marker, or status signal may indicate when the registration signal occurs in frequency; and in some systems, it may indicate its duration in time; and/or in some systems, may indicate the width of the signal (e.g., in a GSM application, it may indicate the pulse width of the registration signal). In some systems, the duration of the registration signal may determine how long a flag or maker may be set or how long the status signal is transmitted.

Figure 4:
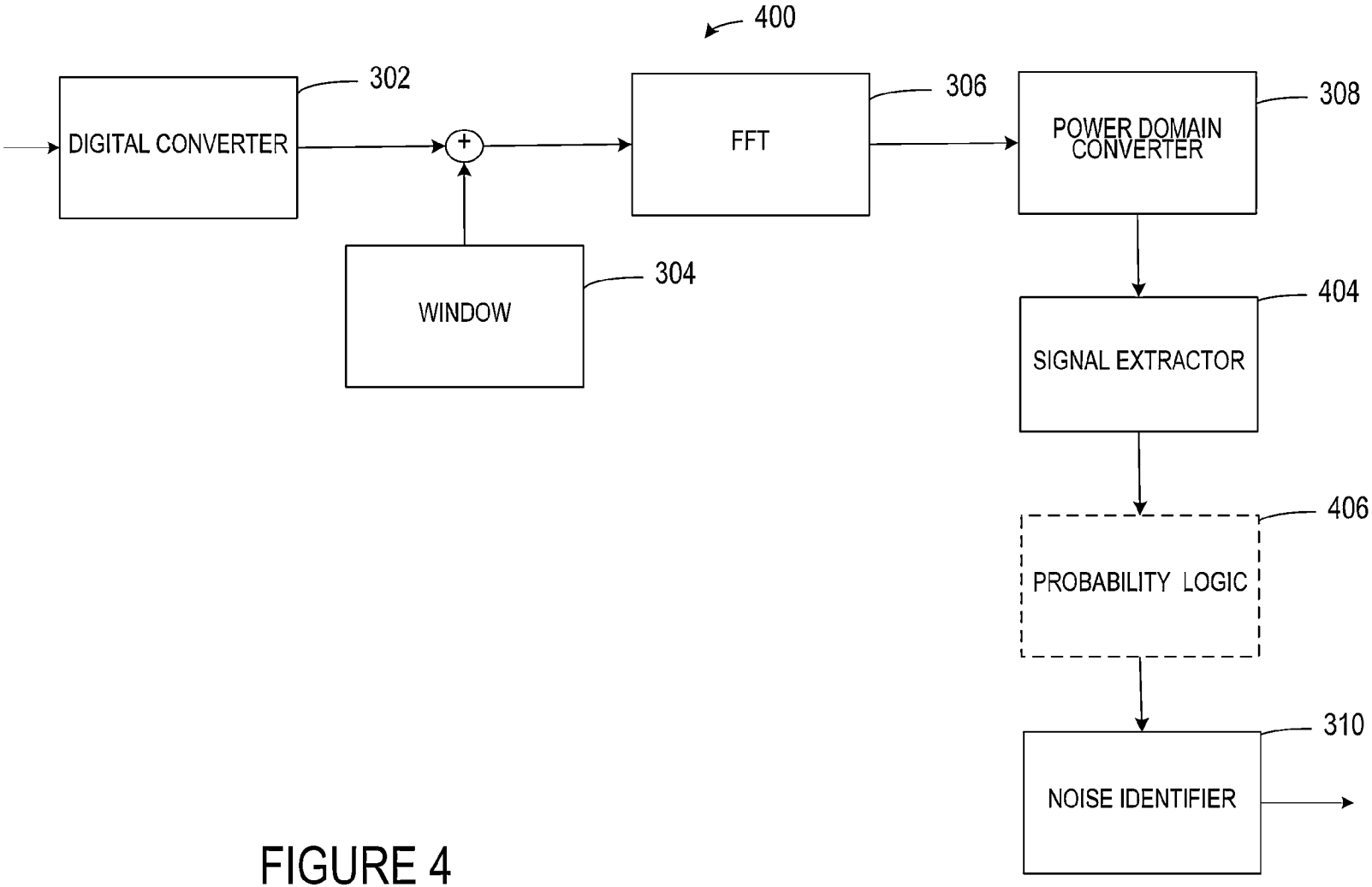
FIG. 4 is an alternative detector that identifies noise or other interference.

FIG. 4 is an alternative detector that also identifies the occurrence of any type of a harmonic signal. The detector 400 digitizes and converts a selected time-varying signal to the frequency domain through a digital converter 302, windowing device 306, and FFT device 306. A power domain converter 308 may convert each frequency bin into the power spectral domain. The power domain converter 308 in FIG. 4 may comprise a power detector that averages the acoustic power in each frequency bin. A signal extractor 404 or signal extraction logic may identify the harmonic signal. The signal extractor 404 may compare spectral characteristics or differences in spectral characteristics to spectral thresholds, templates, or data retained in a local or remote memory. In some systems, harmonics are automatically identified by measuring differences in the data that represent multiple peaks and/or multiple troughs of selected portions of the signal. When the difference in the adjacent frequency bins that comprise a peak and/or trough exceeds a threshold data value, the harmonics may be automatically identified by the noise identifier 310. In alternative systems, harmonics may be automatically identified by analyzing the spectral similarities between the signal and the spectral template. A flag, a marker, or status signal may be set or transmitted based on a probability index calculated through an optional probability device or logic 406. The probability index may comprise a ratio of the number of common occurrences of a harmonic event to the number of possible occurrences in that portion of the signal. In alternative systems, the probability index may comprise a confidence interval that indicates the probability a harmonic was detected.

Figure 5:
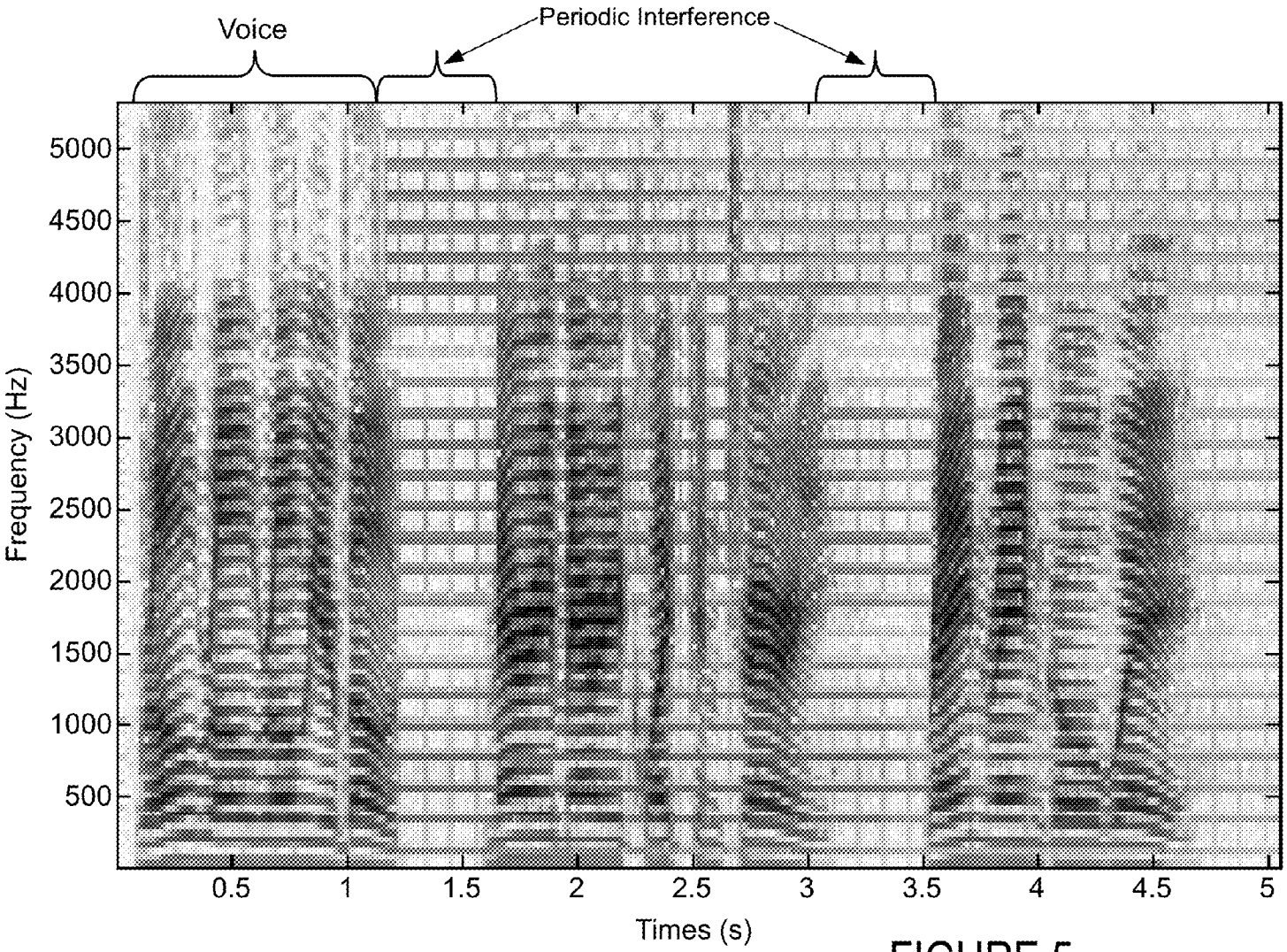
FIG. 5 is a voice sample contaminated with a periodic interference.

FIG. 5 shows a voice sample contaminated with a periodic interference. In this figure, a noise pulse occurring at a fundamental frequency of approximately 217 Hz and integer multiples thereof contaminates speech. In the two-dimensional pattern of speech shown in the spectrogram, the vertical dimension corresponds to frequency and the horizontal dimension to time. The darkness pattern is proportional to signal energy. The voiced regions and interference (which may represent GSM buzz) are characterized by a striated appearance due to the periodicity of the waveform.

Figure 6:
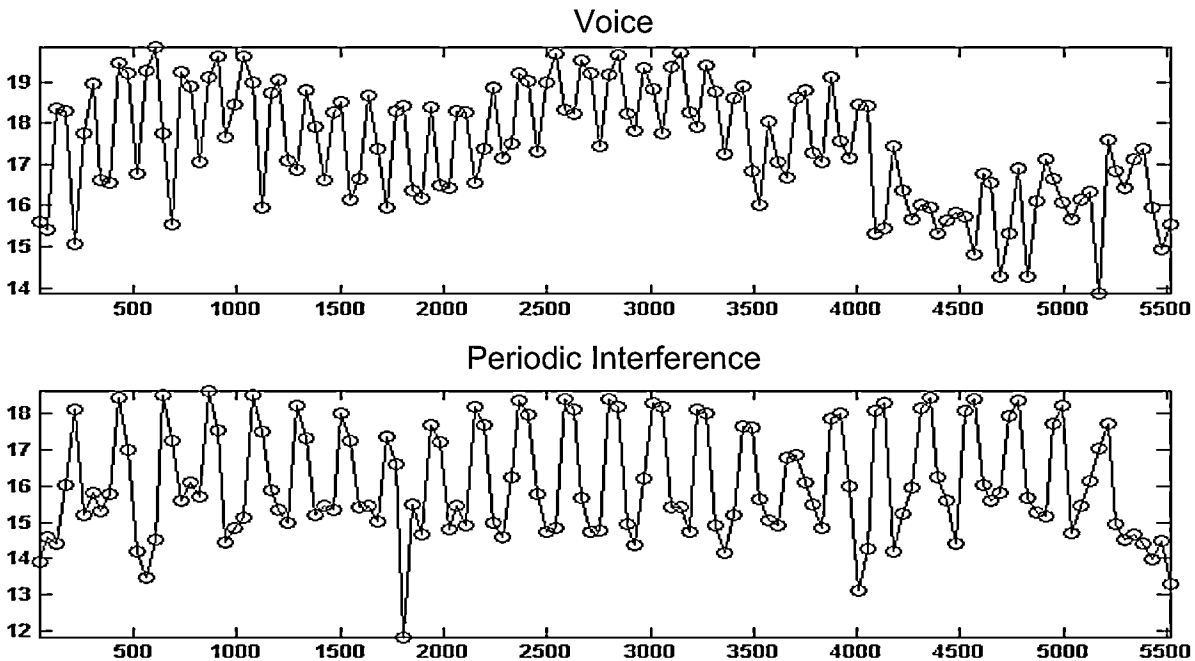
FIG. 6 is a comparison of spectra for voice and a periodic interference.

In the log domain, the similarity in structure may be seen by a comparison of the spectra for voice to GSM buzz (e.g., approximately 217 Hz plus harmonics shown as an exemplary periodic interference in FIG. 6). While the peaks and valleys of the interference and voiced signal are not substantially coincident, they have a similar structure. In the two dimensional graph of FIG. 6, the vertical dimensions correspond to a normalized intensity (such as dB) and the horizontal dimension to frequency.

Figure 7:
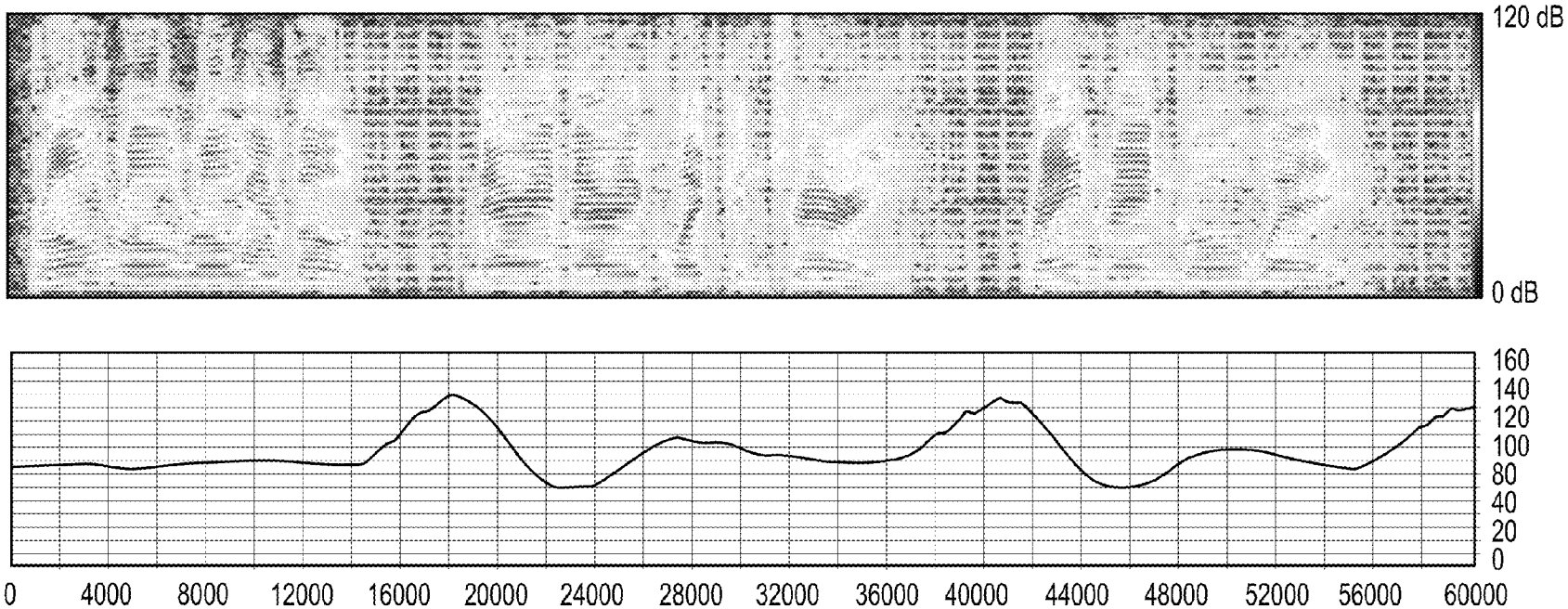
FIG. 7 is a voice signal contaminated with a periodic interference positioned above an output of a probability device or logic.

FIG. 7 shows a spectrogram of a voice signal contaminated with a periodic interference positioned above an exemplary output of probability logic. In FIG. 7, a strong electromagnetic pulse having a root frequency occurring at approximately 217 Hz contaminates a voice segment. When the electromagnetic pulse is present, the probability of the signal's detection present rises over time but decreases when voice appears as shown in the lower graph (e.g., an output of an exemplary probability logic). The smooth value of the probability may be a function of the number of buffers or bins that the process or system averaged or smoothed.

Figure 8:
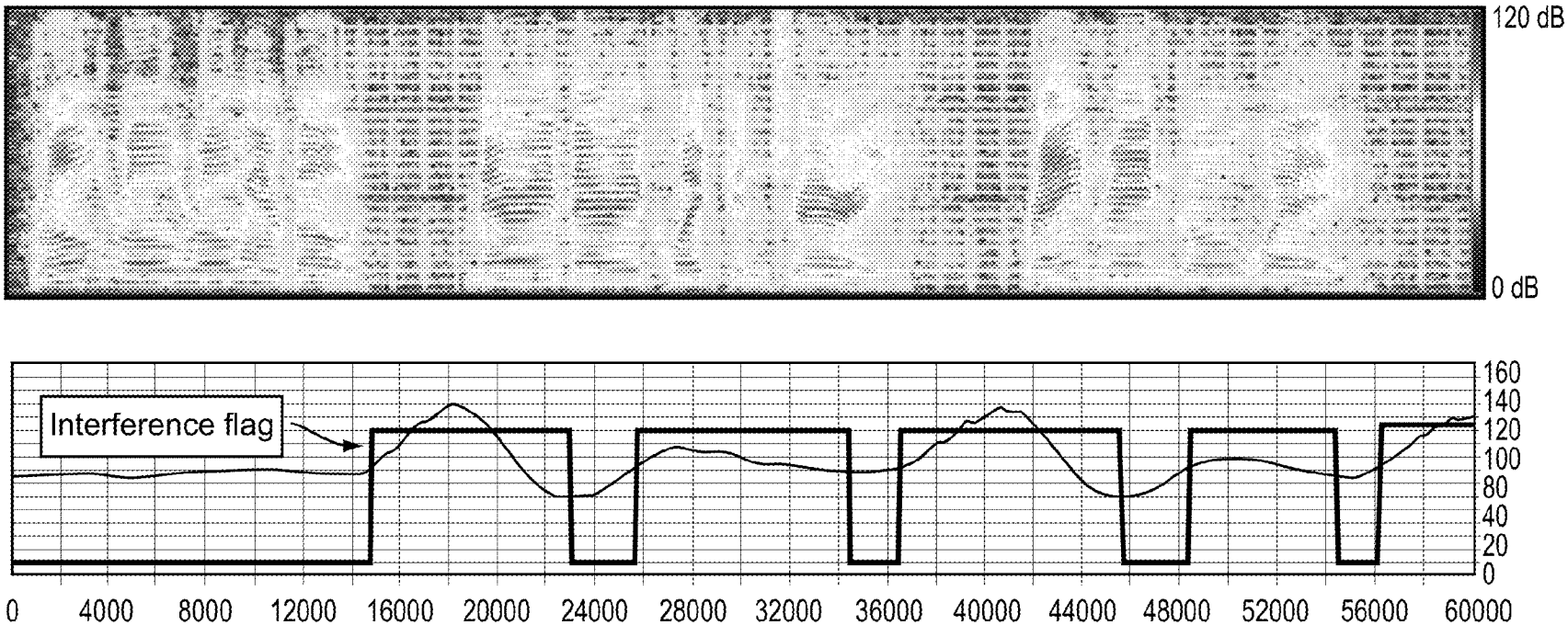
FIG. 8 is a voice signal contaminated with a periodic interference positioned above an output of the noise detector and the output of the probability device or logic.

FIG. 8 shows a voice signal contaminated with a periodic interference positioned above an output of the noise detector and the output of the probability logic. The interference flag may indicate when the noise occurs, and in some processes, may indicate its duration. In FIG. 8, the pulse width of the interference flag is substantially correlated to the pulse width of the registration signal of an exemplary GSM device. The rising edge of the interference flag has been empirically offset by a programmed increment, and in some systems and processes, the offset may be programmed or changed automatically or by a user through a user interface in communication with the noise identifier. The device or user may increase or decrease the number of frequency bins or buffers in a sequence or in a uninterrupted row that need to be above a predetermined threshold to trigger the flag to tailor the system or method to the user's or ancillary process or device's performance needs.

Figure 9:
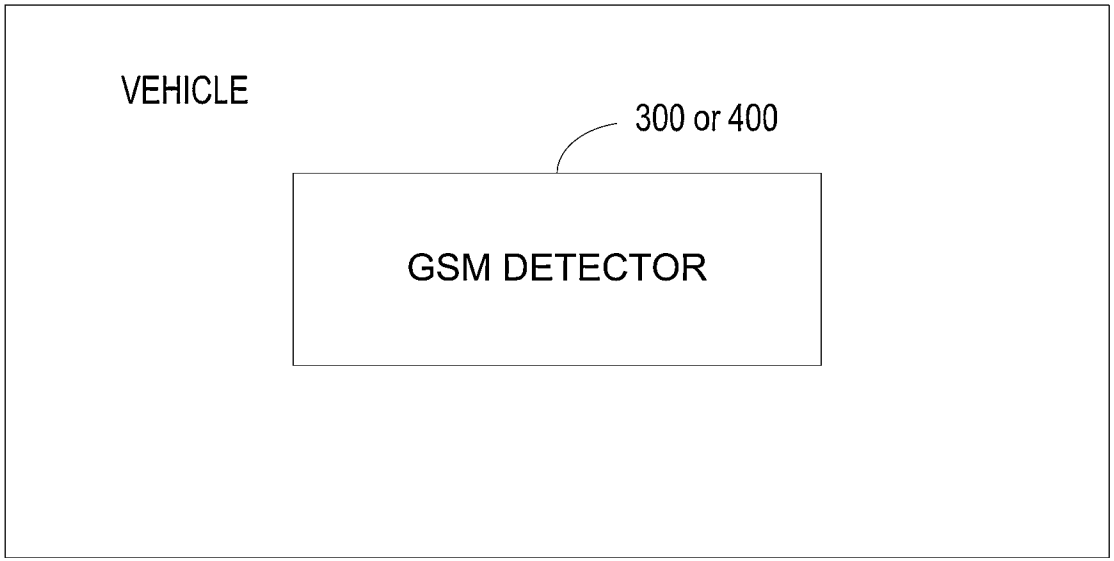
FIG. 9 is a noise detector such as a GSM detector integrated within a vehicle.
Figure 10:
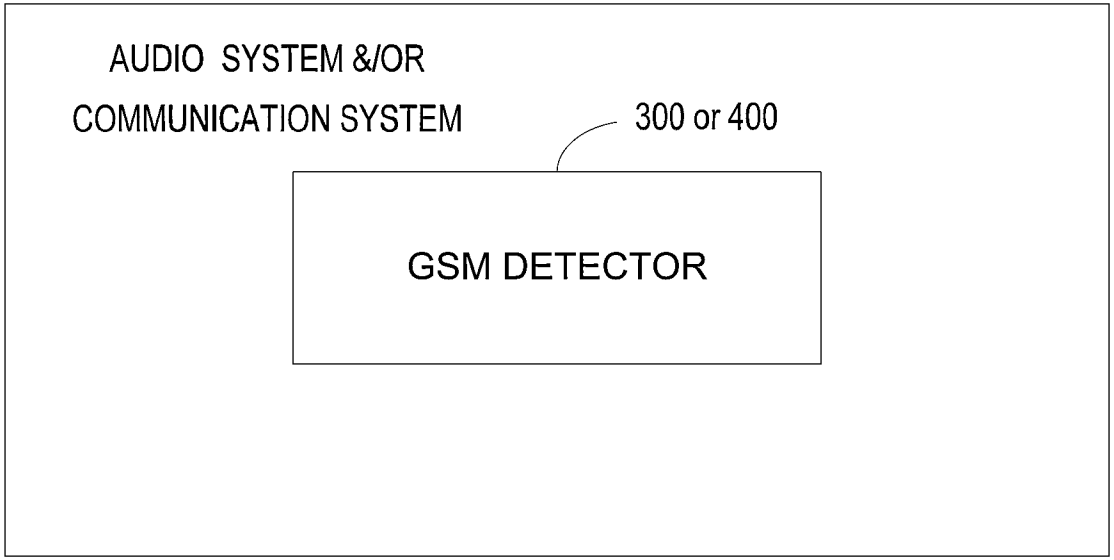
FIG. 10 is a noise detector such as a GSM detector integrated within hands-free communication device, a communication system, and/or an audio system.

The methods and descriptions of FIGS. 1 and 2 may be encoded in a signal bearing medium, a computer readable medium such as a memory that may comprise unitary or separate logic, programmed within a device such as one or more integrated circuits, or processed by a controller or a computer. If the methods are performed by software, the software or logic may reside in a memory resident to or interfaced to one or more processors or controllers, a wireless communication interface, a wireless system, an entertainment and/or comfort controller of a vehicle or types of non-volatile or volatile memory remote from or resident to a detector. The memory may retain an ordered listing of executable instructions for implementing logical functions. A logical function may be implemented through digital circuitry, through source code, through analog circuitry, or through an analog source such as through an analog electrical, or audio signals. The software may be embodied in any computer-readable medium or signal-bearing medium, for use by, or in connection with an instruction executable system, apparatus, device, resident to a vehicle as shown in FIG. 9 or a hands-free system communication system or audio system shown in FIG. 10. Alternatively, the software may be embodied in media players (including portable media players) and/or recorders, audio visual or public address systems, desktop computing systems, etc. Such a system may include a computer-based system, a processor-containing system that includes an input and output interface that may communicate with an automotive or wireless communication bus through any hardwired or wireless automotive communication protocol or other hardwired or wireless communication protocols to a local or remote destination or server.

A computer-readable medium, machine-readable medium, propagated-signal medium, and/or signal-bearing medium may comprise any medium that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical or tangible connection having one or more wires, a portable magnetic or optical disk, a volatile memory such as a Random Access Memory "RAM" (electronic), a Read-Only Memory "ROM," an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled by a controller, and/or interpreted or otherwise processed. The processed medium may then be stored in a local or remote computer and/or machine memory.

The system may dynamically identify substantially all of the harmonics of a targeted signal by processing a limited segment of the signal. The harmonics may be combined with a speech signal and may still be detected in an enclosure or an automobile. In an alternate system, aural signals may be selected by a dynamic filter and the harmonics may be detected by a threshold and/or slope detector in the time domain.

Other alternate systems include combinations of some or all of the structure and functions described above or shown in one or more or each of the Figures. These systems are formed from any combination of structure and function described herein or illustrated within the figures. In some alternate systems and processes, the registration signals described herein may comprise harmonic signals. In some systems and processes, the likelihood of detection or the probability index may occur (e.g., may be generated) after the marker, flag, or signal is set or generated. In each of these systems and processes, the logic may be implemented in software or hardware. The hardware may be implemented through a processor or a controller accessing a local or remote volatile and/or non-volatile memory that interfaces peripheral devices or the memory through a wireless or a tangible medium While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A process that improves speech processing by identifying registration signals comprising periodic interference by processing a limited frequency band comprising:

converting a limited frequency band of a continuously varying input into a digital-domain signal;

converting the digital-domain signal into a frequency-domain signal;

estimating the differences between a plurality of sets of adjacent frequency bins of the frequency-domain signal automatically;

comparing the estimated differences of the plurality of sets of adjacent frequency bins to a pre-programmed threshold automatically; and identifying a periodic interference across an aural spectrum based on the comparison automatically in real time where the act of identifying the periodic interference comprises embedding a code in the continuously varying input in a digital domain.

2. The process that improves speech processing by identifying registration signals of claim 1, where the identification stores a code stored in a local memory.

3. The process that improves speech processing by identifying registration signals of claim 1, where the identification indicates when the periodic interference first occurs and its duration across the aural spectrum.

4. The process that improves speech processing by identifying registration signals of claim 1, where the identification comprises setting a flag.

5. The process that improves speech processing by identifying registration signals of claim 1, further comprising modifying the pre-programmed threshold through a user interface.

6. The process that improves speech processing by identifying registration signals of claim 1, where the continuously varying input comprises an unvoiced input.

7. The process that improves speech processing by identifying registration signals of claim 1, where the continuously varying input comprises a fully voiced input.

8. The process that improves speech processing by identifying registration signals of claim 1, where the continuously varying input comprises a mixed voiced input.

9. A system that detects interference that is received with an unvoiced, a fully voiced, or a mixed voice input comprising:

a digital converter that converts a time-varying input signal into a digital- domain signal;

a window function configured to pass signals within a programmed aural frequency range while substantially blocking signals above and below the programmed aural frequency range when multiplied by an output of the digital converter;

a frequency converter that converts the digital domain signals passing within the programmed aural frequency range into a plurality of frequency bins;

a noise detector configured to compare the covariance of a plurality of the frequency bins to a programmed threshold to determine when a periodic interference is present in the unvoiced, the fully voiced, or the mixed voice input automatically.

10. The system that detects interference that is received with the unvoiced, the fully voiced, or the mixed voice input of claim 9 further comprising a power domain converter configured to convert the output of the frequency converter into a power spectral domain.

11. The system that detects interference that is received with the unvoiced, the fully voiced, or the mixed voice input of claim 10, where the power domain converter estimates the amplitude of each of the plurality of frequency bins through a weighted average.

12. The system that detects interference that is received with the unvoiced, the fully voiced, or the mixed voice input of claim 10, where the power domain converter estimates the amplitude of each of the plurality of frequency bins through an average.

13. The system that detects interference that is received with the unvoiced, the fully voiced, or the mixed voice input of claim 10 further comprising a signal extractor configured to identify one or more harmonic signals from the output of the power domain converter by comparing differences in spectral characteristics of the plurality of frequency bins or by comparing spectral characteristics of the plurality of frequency bins to a spectral template.

14. The system that detects interference that is received with the unvoiced, the fully voiced, or the mixed voice input of claim 13, where a probability device determines a probability index for the one or more harmonic signals and a flag is communicated that indicates the probability that one or more harmonic signals is detected.

15. The system that detects interference that is received with the unvoiced, the fully voiced, or the mixed voice input of claim 9, further comprising a power domain converter that estimates the amplitude of each of the plurality of frequency bins through a weighted average.

16. The system that detects interference that is received with the unvoiced, the fully voiced, or the mixed voice input of claim 9, where the noise detector is configured to set a flag that indicates when a registration signal occurs.

17. The system that detects interference that is received with the unvoiced, the fully voiced, or the mixed voice input of claim 16, where the flag identifies the frequency of the periodic interference.

18. The system that detects interference that is received with the unvoiced, the fully voiced, or the mixed voice input of claim 16, where the flag identifies the pulse width of the periodic interference.

19. The system that detects interference that is received with the unvoiced, the fully voiced, or the mixed voice input of claim 9, where the periodic interference comprises a Global System for Mobile Communication interference.

20. The system that detects interference that is received with the unvoiced, the fully voiced, or the mixed voice input of claim 9, where the programmed threshold comprises a plurality of programmed thresholds.

* * * * *